US005634580A

United States Patent [19]

Levy

[11] Patent Number: 5,634,580

[45] Date of Patent: Jun. 3, 1997

[54] CLIP-ON TAPE DISPENSER FOR REELED TAPE

[75] Inventor: David Levy, Yavne, Israel

[73] Assignee: I.T.S. Machinery Development Ltd., Petach Tikvah, Israel

[21] Appl. No.: 492,862

[22] Filed: Jun. 20, 1995

Related U.S. Application Data

[63] Continuation of Ser. No. 174,476, Dec. 28, 1993, abandoned.

[30] Foreign Application Priority Data

Jan. 5, 1993 [IL] Israel ..... 104309

[51] Int. Cl.[6] ..... B65H 35/07; B65H 3/02

[52] U.S. Cl. ..... 225/56; 225/65; 225/88; 225/90; 24/563

[58] Field of Search ..... 225/56–65, 90, 225/55, 88; 24/561, 562, 563; 206/53, 54, 55

[56] References Cited

U.S. PATENT DOCUMENTS

| | | | |
|---|---|---|---|
| 693,122 | 2/1902 | Dorsey | 24/562 X |
| 2,528,958 | 11/1950 | Johnson | 225/66 X |
| 2,560,394 | 7/1951 | Slezak | 225/65 X |
| 2,611,432 | 9/1952 | Tallman | 225/57 X |
| 2,670,042 | 2/1954 | Isler | 225/57 |
| 3,395,841 | 8/1968 | Brown | 225/65 |
| 3,450,318 | 6/1969 | Turner | 225/65 |
| 3,970,230 | 7/1976 | Horn | 225/65 |
| 4,496,276 | 1/1985 | Shulyak | 225/65 |

FOREIGN PATENT DOCUMENTS

| | | | |
|---|---|---|---|
| 498366 | 1/1951 | Belgium | 225/56 |
| 573405 | 6/1924 | France | 24/561 |
| 43597 | 4/1977 | Japan | 225/56 |
| 791642 | 3/1958 | United Kingdom | 225/66 |
| 838055 | 6/1960 | United Kingdom | 24/562 |

*Primary Examiner*—Rinaldi I. Rada
*Assistant Examiner*—Clark F. Dexter
*Attorney, Agent, or Firm*—Rogers & Killeen

[57] ABSTRACT

A clip-on tape dispenser for reeled tape comprises, in integral configuration, a middle section, at least portions of which are designed to ride on the outermost turn of the reeled tape, and two flank sections located on either side of the middle section in planes substantially perpendicular to the general plane containing the middle section, and a cutting section being part of and folded up from the middle section and having a tape-cutting edge. The dispenser has at least one tooth-like member provided in at least one of the flanks and configured in such a way as to permit the dispenser to be easily clipped onto the reeled tape in a substantially radial direction thereto and to be slid thereon in a circumferential direction, but to oppose dislodgement of the dispenser in the substantially radial direction.

9 Claims, 4 Drawing Sheets

CLIP-ON TAPE DISPENSER FOR REELED TAPE

This is a continuation of application Ser. No. 08/174,476, filed Dec. 28, 1993now abandoned.

BACKGROUND OF THE INVENTION

The present invention relates to a clip-on tape dispenser for reeled tape.

Everybody is familiar with the frustrating experience of trying first to locate the end of a reeled adhesive tape, then to pry this end loose and, finally, to tear off the required length of tape. For this reason there have come into use a wide selection of tape dispensers which, having a cutting edge, facilitate tearing off a length of tape and prevent spontaneous reattachment of the tape end to the roll.

These tape dispensers are, however, heavy and/or bulky, being much larger than the tape roll they accommodate. They are also relatively expensive.

A more compact tape shear is known from U.S. Pat. No. 4,496,276. This shear, made of a plastic material, is transversely strapped around the tape roll and its core, and is locked in that position by a locking tongue which is part of one wing of the device, engaging a slotted projection in a second wing. These wings are provided with a plurality of fingers carrying pegs which press, in the mounted position, against the sides of the layers of the roll. The tape is cut with the aid of a cutting edge. The holding force provided by the pegs decreases, however, with the decreasing thickness of the tape layers, resulting in loss of stability of the cutting edge when the tape is pulled across it.

While other compact tape dispensers are known, none of them is held in position by engaging the sides of the roll only.

It is one of the objects of the present invention to overcome the disadvantages and inadequacies of the prior art tape dispensers and to provide a tape dispenser that is of miniature size and weighs only a few grams, yet when applied to the tape reel, provides a constant, positive holding force and is, moreover, of negligible cost, while performing the tasks of standard-size tape dispensers.

According to the invention, this is achieved by providing a clip-on tape dispenser for reeled tape, comprising, in integral configuration, a middle section, at least portions of which are designed to ride on the outermost turn of said reeled tape, and two flank sections located on either side of said middle section in planes substantially perpendicular to the general plane containing said middle section, a cutting section being part of and folded up from said middle section and having tape-cutting edge, characterized by at least one tooth-like member provided in at least one of said flanks and configured in such a way as to permit said dispenser to be easily clipped onto said reeled tape in a substantially radial direction thereto and to be slid thereon in a circumferential direction, but to oppose dislodgement of said dispenser in said substantially radial direction.

The invention further provides a blank for a clip-on tape dispenser, comprising, in integral configuration, a middle section, two flank sections, at least one tooth-like member in at least one of said flank sections to be cut free from said flank section, and one cutting section having a cutting edge for said tape to be torn off thereon.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how several forms of the invention may be embodied in practice.

DESCRIPTION OF PREFERRED EMBODIMENTS

Figure 1:
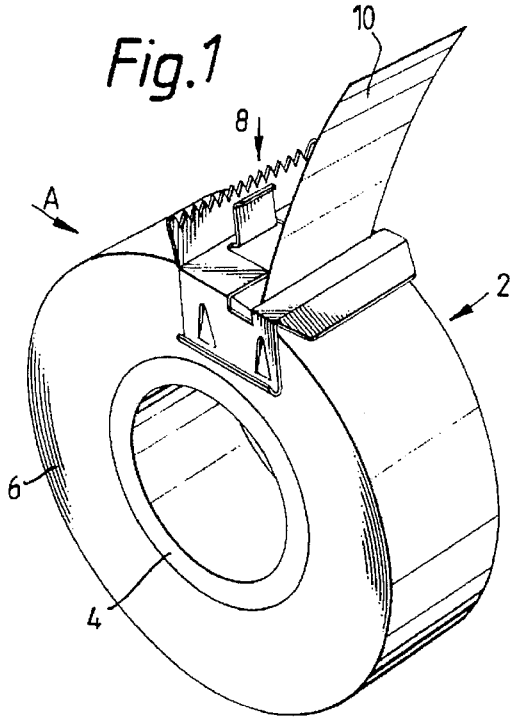
FIG. 1 is a perspective view of the dispenser according to the invention as clipped onto a tape reel.

Referring now to the drawings, there is seen in FIG. 1 a roll of adhesive or other tape 2, comprised of a winding core 4 and a plurality of layers 6 coiled upon one another. The tape dispenser 8, the structure and function of which will be discussed presently, is seen in the clipped-on position (which is its working position), in which it rides on, while straddling the roll 2. Seen also is the free end 10 of the tape.

Figure 2:
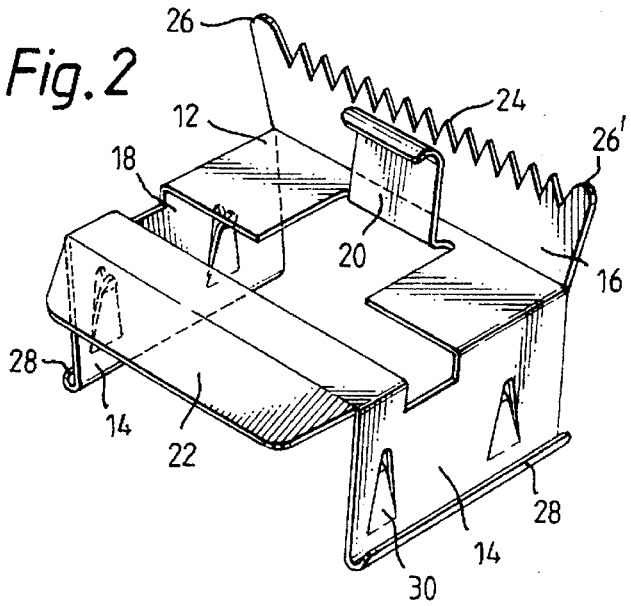
FIG. 2 is a perspective view of a preferred embodiment of the dispenser according to the invention.

A perspective view of a preferred embodiment of the dispenser according to the invention is shown in FIG. 2. There are seen a substantially plane middle section 12, two flank sections 14 on ether side of the middle section 12 and a cutting section 16 extending across, and including an angle with, the middle section 12.

The middle section 12 is provided with a window-like opening 18 extending across the entire middle section 12 and cutting to some extent also into the flank section 14 to facilitate the threading, into the window-like opening 18, of the free end 10 (FIG. 1) of the tape, as the initial preparation of the latter for use of the dispenser according to the invention. The precise way in which the dispenser is used will be described further below.

Further seen as an integral part of the middle section 12 is a tongue 20 raised from the latter and having a bent-over free end. The purpose of this tongue 20 will become apparent further below.

Another integral part of the middle section 12 is an apron 22 slightly slanting downwardly to help the dispenser to sit properly on the curved surface of the tape roll 2.

The cutting edge section 16 is provided with a cutting edge constituted by a plurality of sharp teeth 24, with the first and last teeth 26, 26' being blunted for reasons of safety.

The lower edges 28 of the flanks are curled up or at least outwardly flared, to facilitate clipping on i.e., pushing the device over the roll 2.

Figure 3:
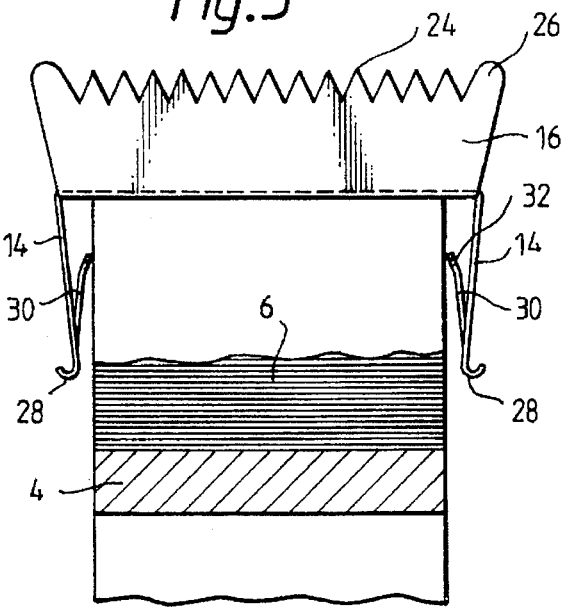
FIG. 3 is an enlarged view of FIG. 1, as seen in the direction of arrow A therein.
Figure 4:
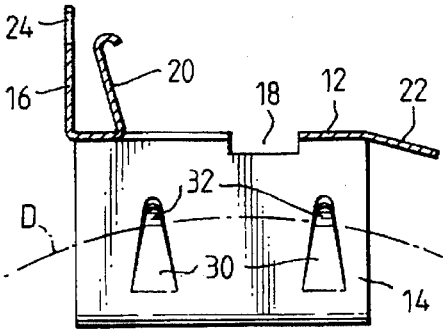
FIG. 4 represents a cross-sectional view of the dispenser of FIG. 2.
Figure 5:
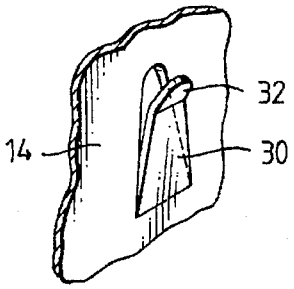
FIG. 5 is an enlarged perspective view of the tooth-like member of FIG. 4.

Each flank 14 is provided with two tooth-like members 30 in the shape of, in this embodiment, and inverted V, which are lanced out from the flank and bent in the inward direction relative to the flanks 14, as seen to best advantage in FIGS. 3 to 5. From these drawings it is also clear that the members 30 are advantageously given another bend close to their tips 32. This bend is, however, not about a line parallel to the base of the V, but about lines tangential to an imaginary circle D, which represents a mean diameter of the turns of the tape. It will thus be appreciated that, when the dispenser according to the invention is pushed over roll 2, the tooth-like members 30, partly due to being flexible by themselves and partly due to the flexibility of the flanks 14, offer little resistance to being pushed over the roll 2; but when an attempt is made to pull out the dispenser 8 in a direction opposite to the direction it was pushed over the roll, the members 30 and their tips 32 act as barbs, and resist removal of the dispenser. There is, however, no resistance to a sliding movement in the circumferential direction of the roll, as the tips 32, assisted by the abovementioned tangentiality of their bend, penetrate to some degree between adjacent tape layers 6 and, in their circumferential sliding motion brought about by the peeling off of a length of tape (to be discussed presently), are to some extent guided by these layers.

To mount and use the dispenser 8 (see FIG. 6), the free end 10 of the tape (dash-dotted line) is first threaded from below into the window-like opening 18. Then the dispenser 8 is clipped or pushed onto the roll 2 and the tape end 10 gripped and pulled to the right in the direction of arrow B (dashed line). This causes the tape to peel off the roll 2, pulling along the dispenser 8 in the clockwise sense. When the required length of tape has been peeled off, it is swung to the left (solid line) across the cutting edge of the cutting section 16, and torn off.

At this point, the purpose of the above-mentioned tongue 20 becomes obvious: After tearing off the required length of tape, the tongue 20, by holding up the freshly created end of the tape, prevents it from drooping down and reattaching itself to the coiled tape and, being thus held up at a distance from the roll surface, this new end is easily gripped and pulled as in FIG. 6, to provide another length of tape.

Figure 7:
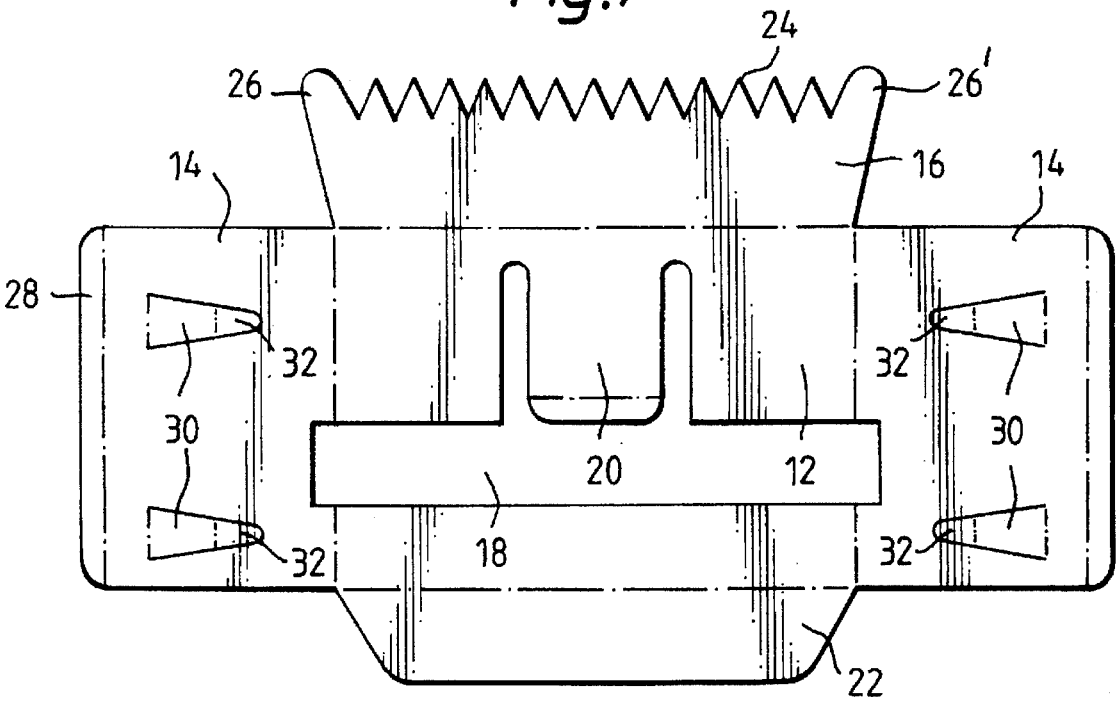
FIG. 7 represents the blank used to produce the preferred embodiment of FIG. 2, and FIGS. 8–13 illustrate several additional embodiments of the dispenser according to the invention.

FIG. 7 illustrates a sheet-metal blank for the preferred embodiment of the dispenser 8 of FIG. 2. The dash-dotted lines signify the various bending lines and numerals indicate the various sections and features as enumerated and explained in the aforegoing.

Several additional embodiments of the dispenser 8 are represented in FIGS. 8–13.

Figure 8:
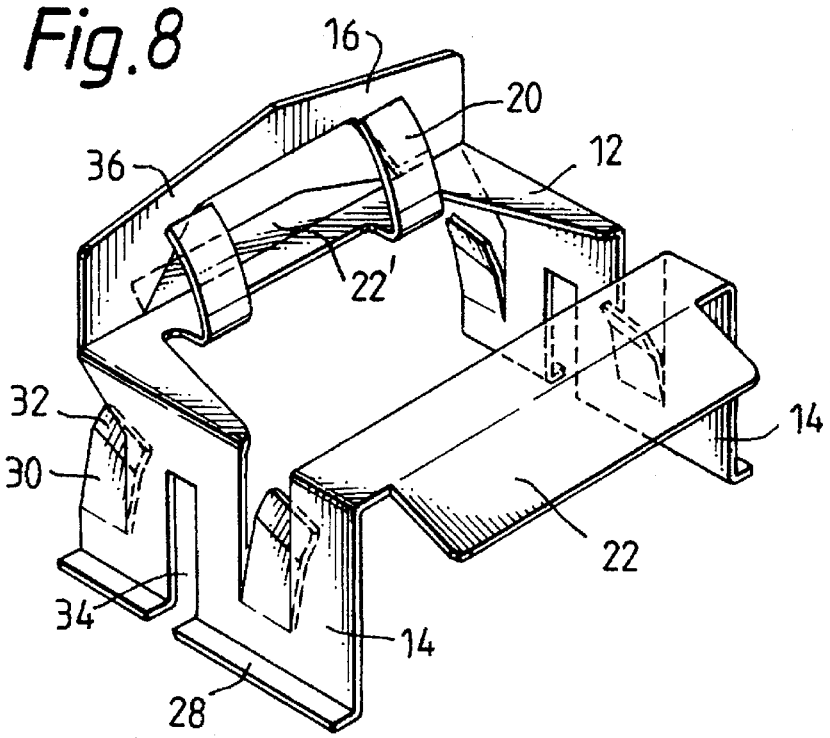

The embodiment of FIG. 8 shows a cutting section with a knife edge 36 which is non-serrated and slants from the center outwards and downwards. Further seen is a slot 34 located in the flanks 14 and enhancing the independent flexing of these flanks. There is also provided two tongues 20, as well as two aprons 22, 22', the latter being located in front of cutting section 16. The edges 28 of the flanks 14 are outwardly flaring. It is seen that one of the members 30 is disposed right at the lateral edge of the flank 14.

Figure 9:
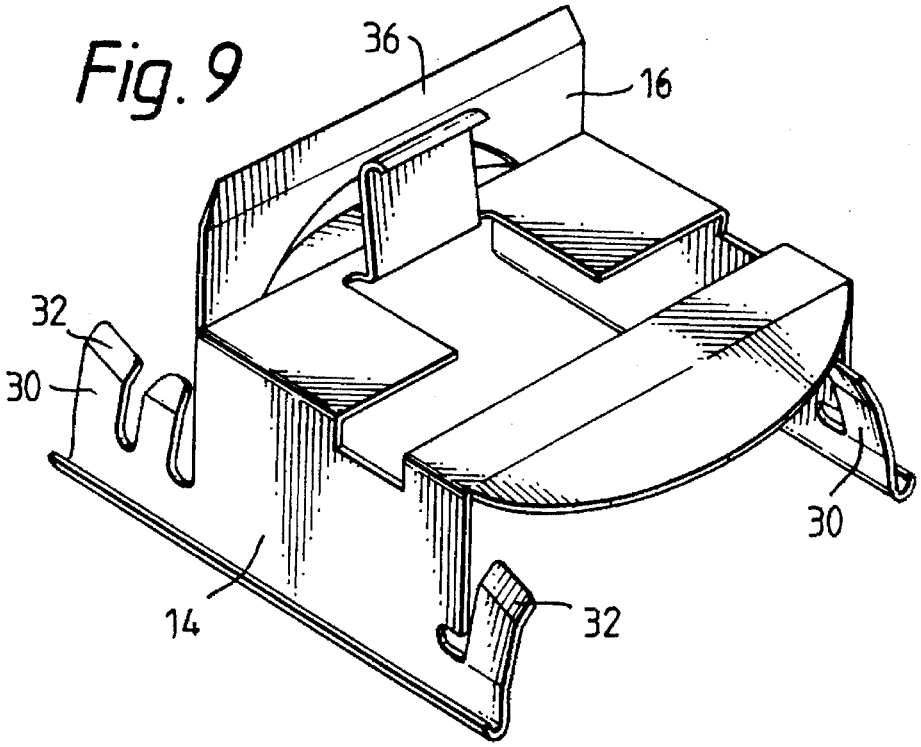

A similarly non-serrated knife edge 36 is also provided in the dispenser of FIG. 9, the knife edge being, however, straight rather than slanting. Three tooth-like members 30 are provided on each flank 14 with the distance between the first and the third members being larger than in the previous embodiments. This reduces the force acting on each of the tooth-like members 30.

Figure 10:
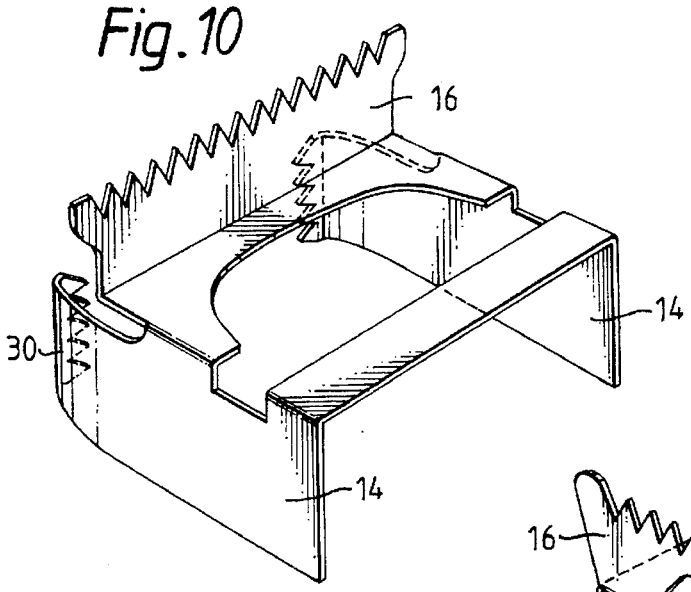

The embodiment of FIG. 10 has only one flexible member 30' on each flank, the active edge of which member is vertical and serrated, engaging the roll side along the entire active edge.

Figure 11:
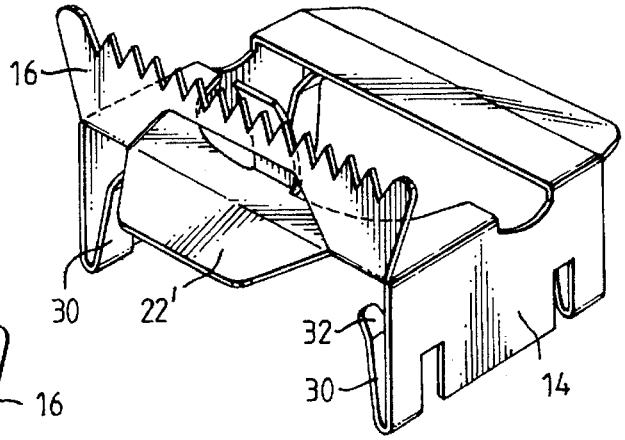
Figure 12:
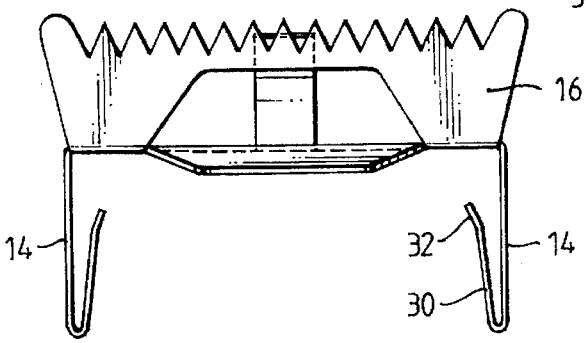
Figure 13:
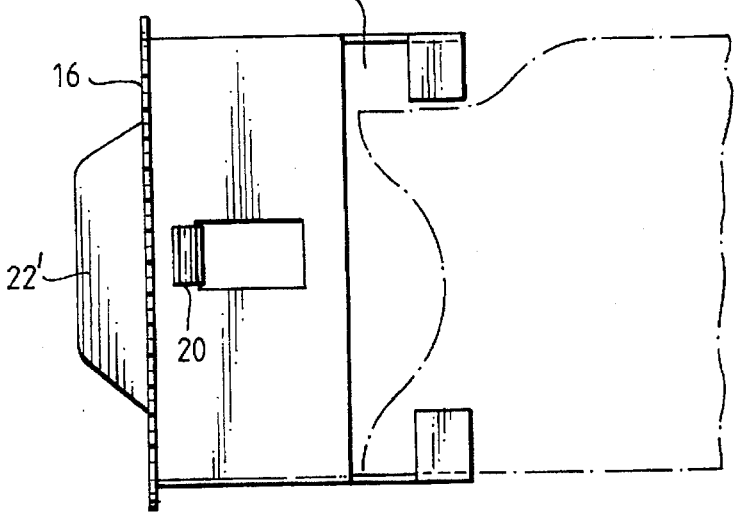

In the embodiment of FIGS. 11 and 12, the four members 30 are folded inwardly from the edges of the flank sections 14, as clearly seen, with the tips 32 bent to facilitate their "biting" into the roll 2.

Figure 6:
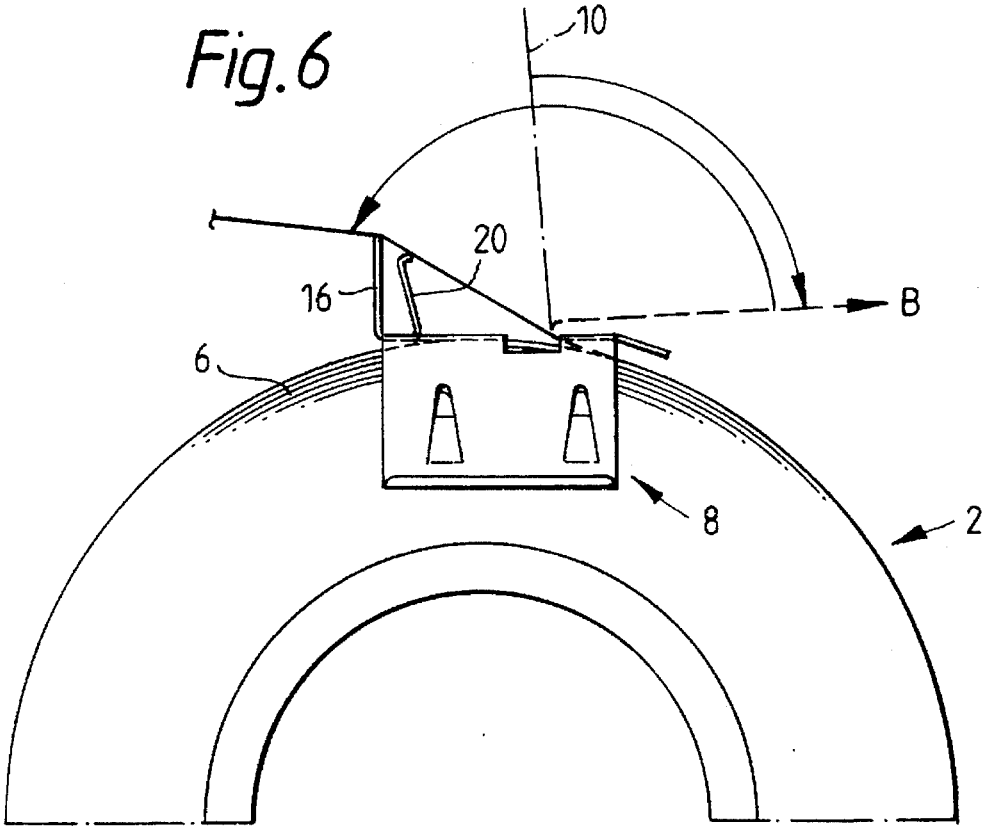
FIG. 6 illustrates the manner in which tape is peeled off the tape roll and subsequently cut.

As can be seen in the top view of yet another embodiment (FIG. 13), the window-like opening 18 is partly open towards the right, which to some degree simplifies the initial mounting of the dispenser, as the end of the tape need no longer be threaded from below through the window 18, but can be easily manoeuvered into the window by slightly flexing the tape, as seen in the drawing. In this embodiment, the tape is advantageously pulled towards the cutting section 16 for peeling off a length of tape (in contradistinction to what is shown in FIG. 6, where the tape is pulled in a direction away from the cutting section).

It is, of course, possible to use the dispenser according to the invention without engaging the tape end in the window-like opening 18, whether closed or partly open, by simply peeling off the required length and then, in a separate action, sliding the dispenser towards the roll-side of the peeled-off tape length in order to tear off that length.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A clip-on tape dispenser for reeled tape comprising:

a middle section for riding along an outermost turn of the reeled tape;

two flank sections depending downwardly from said middle section toward the reeled tape when the dispenser is mounted on the reel tape;

a cutting section depending upwardly from said middle section and having a tape-cutting edge at a top portion thereof; and at least one tooth member in at least one of said flanks, said tooth member having a first portion that extends towards the opposing one of said flanks and an upwardly depending free end that is angled more towards said opposing one of said flanks than said first portion along a line substantially tangential to a circle centered on a line generally parallel to said middle section gripping means in at least one said two flanks for holding the dispenser on the reeled tape, said gripping means comprising a first portion angled toward the opposing one of said two flanks and a second portion angled more toward the opposing one of said two flanks than said first portion;

a cutting section depending upwardly from said middle section and having a tape-cutting edge at a top portion thereof; and a tongue depending upwardly from said middle section for supporting the free end of the reeled tape, said tongue having a height that reaches at least to an imaginary line extending from said opening to said tape-cutting edge.

2. The tape dispenser of claim 1 further comprising at least one tongue raised from said middle section to a height which is at most equal to a height of said cutting section.

3. The tape dispenser of claim 1 wherein said upwardly depending free end has a rounded tip.

4. The tape dispenser of claim 1 wherein said at least one tooth-like member has an outline of an inverted V.

5. A clip-on tape dispenser for reeled tape comprising:

a middle section for sliding along an outermost turn of the reeled tape, said middle section having an opening for extending a free end of the reeled tape therethrough;

two flanks depending downwardly from said middle section toward the reeled tape for holding the dispenser on the reeled tape.

6. The tape dispenser of claim 5 wherein said second portion has a rounded tip.

7. The tape dispenser of claim 5 wherein said gripping means has an outline of an inverted V.

8. The tape dispenser of claim 5 wherein said second portion is angled along a line substantially tangential to a circle centered on a line generally parallel to said middle section.

9. A clip-on tape dispenser for reeled tape, comprising, in integral configuration:

a middle section designed to slide on an outermost turn of said reeled tape comprising an opening substantially as wide as said middle section, and two flank sections located on either side of said middle section in planes substantially perpendicular to a plane containing said middle section, a cutting section being part of, and extending upwardly from, said middle section and having a tape-cutting edge at a top portion thereof, and at least one flexible tooth member provided in at least one of said two flank sections, said tooth member having an upwardly extending free end projecting towards the opposing one of said flank sections for engagement with a side of said reeled tape so that said dispenser can be easily clipped onto said reeled tape in a substantially radial direction thereto and can be slid thereon in a circumferential direction, but opposes dislodgement of said dispenser in a direction generally opposed to said substantially radial direction, wherein said at least one tooth member comprises a first portion angled toward the opposing one of said two flanks sections and a second portion angled more toward the opposing one of said two flanks sections than said first portion.

* * * * *